US010601186B2

(12) United States Patent
Chien et al.

(10) Patent No.: US 10,601,186 B2
(45) Date of Patent: Mar. 24, 2020

(54) PLUG ELECTRICAL CONNECTOR

(71) Applicant: Advanced Connectek Inc., New Taipei (TW)

(72) Inventors: Min-Lung Chien, New Taipei (TW); Ming-Yung Chang, New Taipei (TW); Cheng-Che Tsai, New Taipei (TW); Ling-Tai Liu, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/150,235

(22) Filed: Oct. 2, 2018

(65) Prior Publication Data

US 2019/0103712 A1 Apr. 4, 2019

(30) Foreign Application Priority Data

Oct. 3, 2017 (CN) ..... 2017 1 0925183

(51) Int. Cl.

| | |
|---|---|
| ***H01R 13/66*** | (2006.01) |
| ***H01R 13/6597*** | (2011.01) |
| ***H01R 13/6581*** | (2011.01) |
| ***H01R 13/6591*** | (2011.01) |
| ***H01R 13/703*** | (2006.01) |
| *H01R 107/00* | (2006.01) |
| *H01R 24/60* | (2011.01) |
| *H01R 13/11* | (2006.01) |

(52) U.S. Cl.

CPC ..... *H01R 13/6597* (2013.01); *H01R 13/6581* (2013.01); *H01R 13/6591* (2013.01); *H01R 13/7033* (2013.01); *H01R 13/11* (2013.01); *H01R 24/60* (2013.01); *H01R 2107/00* (2013.01)

(58) Field of Classification Search

CPC ..... H01R 13/6597; H01R 13/6591; H01R 13/7033; H01R 13/6581; H01R 24/60; H01R 2107/00; H01R 13/11

USPC ..... 439/607.09, 607.35, 78, 607.1, 607.04, 439/924.1, 924.2, 188, 607.02, 307.17, 439/607.19, 607.36

See application file for complete search history.

(56) References Cited

U.S. PATENT DOCUMENTS

| | | | | |
|---|---|---|---|---|
| 9,525,241 | B1 * | 12/2016 | Su | H01R 13/6581 |
| 9,601,876 | B2 * | 3/2017 | Jiang | H01R 13/6585 |
| 9,647,369 | B2 * | 5/2017 | Tsai | H01R 4/02 |
| 9,768,568 | B1 * | 9/2017 | Jin | H01R 24/60 |
| 9,780,500 | B2 * | 10/2017 | Kao | H01R 12/57 |
| 9,843,148 | B2 * | 12/2017 | Little | H01R 24/60 |
| 9,966,693 | B2 * | 5/2018 | Liu | H01R 13/22 |
| 10,020,619 | B2 * | 7/2018 | Zhang | H01R 12/7082 |
| 10,148,040 | B2 * | 12/2018 | Chien | H01R 13/514 |

(Continued)

*Primary Examiner* — Abdullah A Riyami
*Assistant Examiner* — Nelson R. Burgos-Guntin
(74) *Attorney, Agent, or Firm* — JCIPRNET

(57) ABSTRACT

A plug electrical connector including an insulator, a plurality of elastic terminals, at least one shielding spring, and an outer shell is provided. The elastic terminals are disposed in the insulator and arranged along an axial direction. The elastic terminals includes at least one grounding terminal arranged at a first position or a last position of the elastic terminals. The shielding spring is assembled to an exterior surface of the insulator. A portion of the shielding spring on the axial direction is disposed on a deformable path of the grounding terminal. The insulator, the elastic terminals, and the shielding spring are accommodated in the outer shell.

20 Claims, 6 Drawing Sheets

(56) References Cited

U.S. PATENT DOCUMENTS

| | | | | |
|---|---|---|---|---|
| 10,320,125 | B2 * | 6/2019 | Ju | H01R 13/6585 |
| 2015/0255905 | A1 * | 9/2015 | Little | H01R 13/6658<br>439/78 |
| 2016/0043512 | A1 * | 2/2016 | Kao | H01R 12/57<br>439/620.22 |
| 2018/0026410 | A1 * | 1/2018 | Tsai | H01R 13/502<br>439/607.09 |
| 2018/0294604 | A1 * | 10/2018 | Chien | H01R 13/514 |
| 2019/0103711 | A1 * | 4/2019 | Chien | H01R 13/428 |
| 2019/0103712 | A1 * | 4/2019 | Chien | H01R 13/6597 |

* cited by examiner

PLUG ELECTRICAL CONNECTOR

CROSS-REFERENCE TO RELATED APPLICATION

This application claims the priority benefit of China patent application serial no. 201710925183.1, filed on Oct. 3, 2018. The entirety of the above-mentioned patent application is hereby incorporated by reference herein and made a part of the specification.

BACKGROUND

Technical Field

The invention relates to an electrical connector, and particularly relates to a plug electrical connector.

Description of Related Art

Electrical connectors are a common part in an electronic apparatus, and may be connected with matching electrical connectors in other electronic apparatuses to serve as a signal and power transmission medium between two electrical apparatuses. The conventional electrical connectors include, for example, universal serial bus (USB) connectors. The USB protocol has added the specification of Type-C electrical connectors which, in addition offering an ultra high speed data transmission rate at 10 Gbps, have an insertion slot that is in a symmetrical shape and accepts reversible insertion. Therefore, Type-C USB connectors are broadly used in various electronic apparatuses, such as laptop computers.

Due to the high-frequency transmission property, Type-C USB connectors have a stricter requirement on electromagnetic shielding properties in order not to cause electromagnetic interference to the devices nearby. Generally speaking, in the case of plug electrical connectors, the plug electrical connectors commonly require to additionally dispose a conductive plate on an exterior surface of the insulator in which elastic terminals are accommodated, so as to conduct noise during high-speed signal transmission. But other than that, the conventional USB Type-C connectors are unable to provide an additional function, such as offering a signal switching function or the like such as the function of a switch, when the electrical connectors are connected to each other.

SUMMARY

One or some exemplary embodiments of the invention provide a plug electrical connector having a trigger structure to offer an electrical trigger effect when the plug electrical connector is connected with a receptacle electrical connector.

A plug electrical connector according to an embodiment of the invention includes an insulator, a plurality of elastic terminals, at least one shielding spring, and an outer shell. The elastic terminals are respectively disposed to the insulator and arranged along an axial direction. The elastic terminals include at least one grounding terminal, and the grounding terminal is arranged at a first position or a last position of the elastic terminals. The shielding spring is assembled to the insulator. A portion of the shielding spring in the axial direction is located on a deformable path of the grounding terminal. The outer shell accommodates the insulator, the elastic terminals, and the shielding spring.

According to an embodiment of the invention, the shielding spring is located on a top plane of an exterior surface of the insulator, the grounding terminal is located in the insulator, and an orthogonal projection of the grounding terminal on the top plane is at least partially overlapped with a portion of the shielding spring in the axial direction.

According to an embodiment of the invention, the plug electrical connector is suitable to be connected with another plug electrical connector to deform the elastic terminals. The grounding terminal is driven by a receptacle electrical connector and deformed to abut against a portion of the shielding spring in the axial direction.

According to an embodiment of the invention, the insulator has a plurality of slot holes arranged along the axial direction in correspondence with the elastic terminals, so as to expose the elastic terminals. A portion of the shielding spring in the axial direction shields at least a portion of the slot hole located at a side edge.

According to an embodiment of the invention, the insulator further includes a plurality of protruding ribs, each of the protruding ribs is located between two adjacent slot holes to space apart the two adjacent slot holes and two adjacent elastic terminals.

According to an embodiment of the invention, the shielding spring has an opening located on a top plane of an exterior surface of the insulator and surrounding the protruding ribs, and the shielding spring exposes a portion of the grounding terminal via the opening or the shielding spring completely shields the grounding terminal.

According to an embodiment of the invention, the insulator includes a first member and a second member. Each of the elastic terminals has a retention section and an elastic section. The retention section is fixedly connected to the first member. The second member has the slot holes. The elastic sections are respectively and correspondingly exposed by the slot holes.

According to an embodiment of the invention, the plug electrical connector is suitable to be connected with a receptacle electrical connector to deform the elastic terminals, and the elastic section of the grounding terminal is driven by the receptacle electrical connector to move in the slot hole and abut against the shielding spring.

According to an embodiment of the invention, the second member has a plurality of supporting parts. Each of the supporting parts is disposed in the slot hole and located between two adjacent protruding ribs, and an end of the elastic section leans against the supporting part.

According to an embodiment of the invention, in the slot hole where the grounding terminal is located, a deformable path of the elastic section is in a space between the supporting part and the shielding spring when the grounding terminal is deformed.

According to an embodiment of the invention, the plug electrical connector is a USB Type-C plug electrical connector, and includes a first terminal set and a second terminal set that are disposed to the insulator and are vertically parallel to each other. The first terminal set includes a pair of grounding terminals located at opposite side edges, the second terminal set includes another pair of grounding terminals located at opposite side edges, and the at least one shielding spring includes a pair of shielding springs that are respectively disposed at upper and lower surfaces of the insulator to respectively correspond to the first terminal set and the second terminal set.

Based on the above, in the embodiments of the invention, the insulator, the elastic terminals, and the shielding spring are disposed correspondingly so that the shielding spring is located on the exterior surface of the insulator, the elastic terminals are disposed in the insulator, and a portion of the shielding surface in the same direction as the axial direction on which the elastic terminals are arranged is on the deformable path of the grounding terminal among the elastic terminals. Therefore, the grounding terminal may physically contact the shielding spring while the grounding terminal being bent. Hence, the states of being electrically conductive or not between the grounding terminal and the shielding spring can be brought forth according to whether the electrical connectors are connected or not. In other words, when the plug electrical connector is connected with a receptacle electrical connector, the contact state in which the grounding terminal and the shielding spring is rendered. Once the plug electrical connectors are separated from the receptacle electrical connector, the grounding terminal is again restored to the original state and not bent (and also not contact with the shielding spring). Such configuration renders a trigger effect of being electrically conductive or not, which is similar to a switch. Therefore, by using the switch effect, the plug electrical connector is provided with an additional function of use. Meanwhile, when the electrical connectors (the plug and the receptacle) are connected with each other, since the grounding terminal may contact the shielding spring, the noise can be guided during high speed signal transmission.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
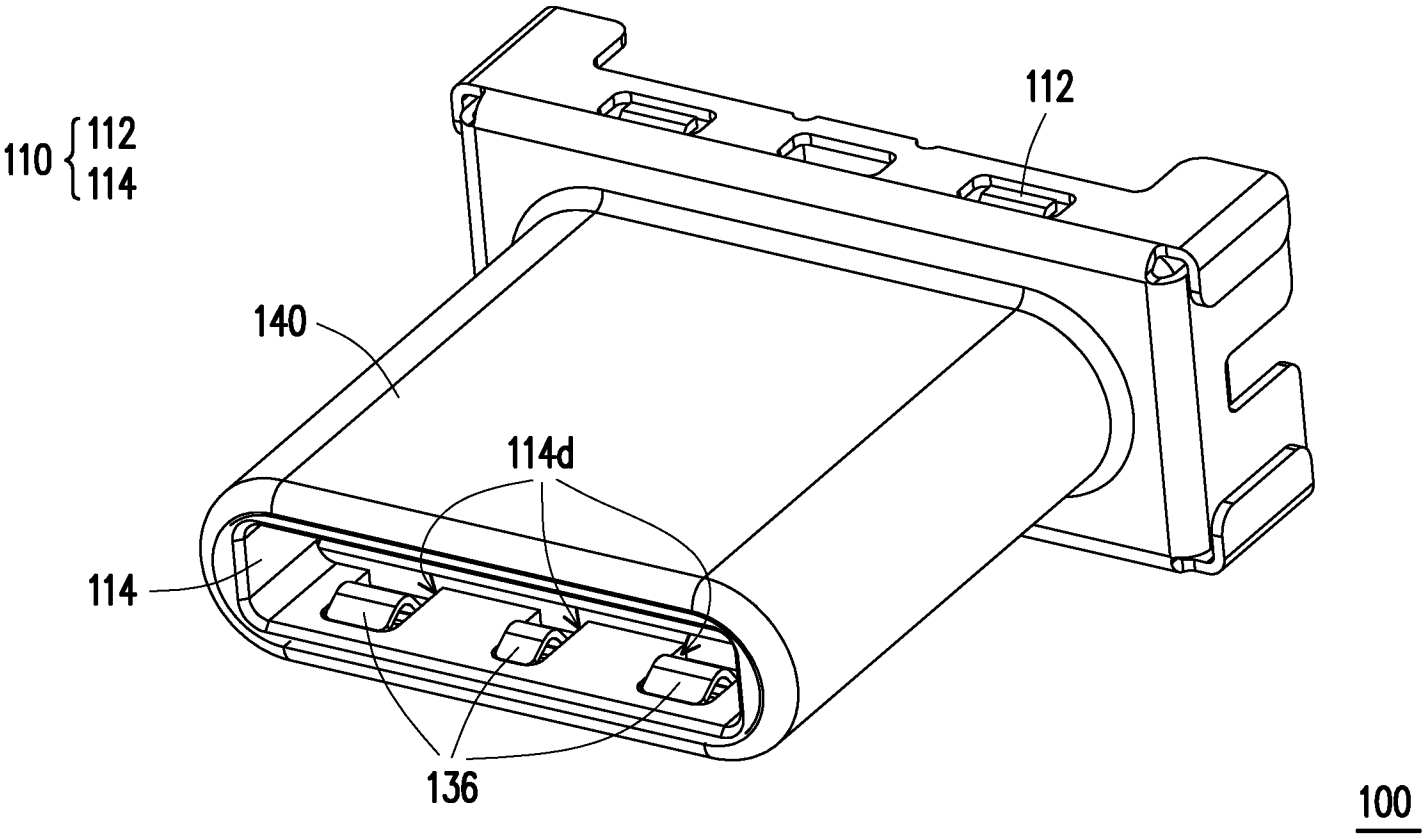
FIG. 1 is a schematic diagram illustrating a plug electrical connector according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
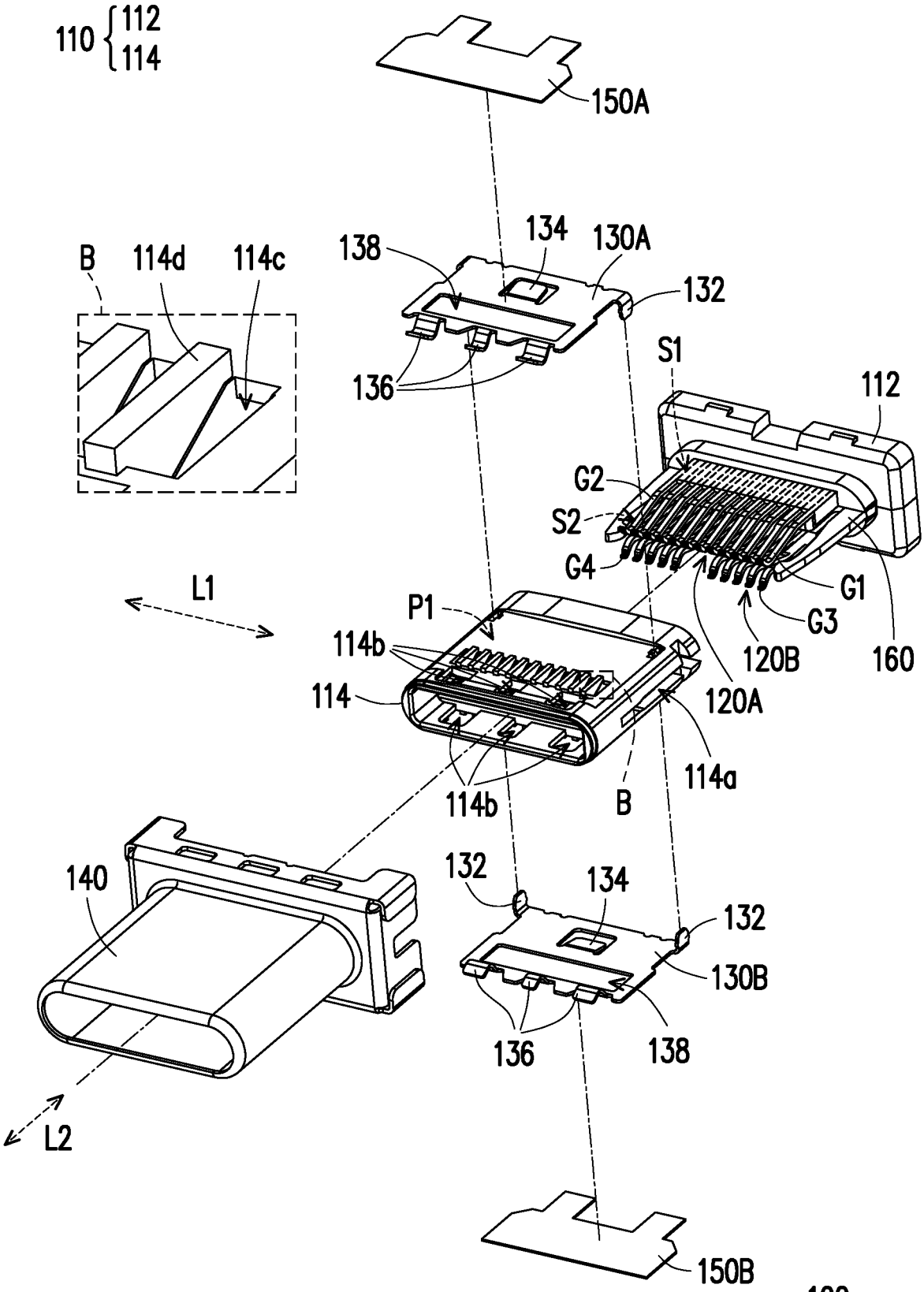
FIG. 2 is an exploded view illustrating the plug electrical connector of FIG. 1.

FIG. 1 is a schematic diagram illustrating a plug electrical connector according to an embodiment of the invention. FIG. 2 is an exploded view of the plug electrical connector of FIG. 1 and has an enlarged view of a portion B for an illustrative purpose. Referring to FIGS. 1 and 2 in the embodiment, a plug electrical connector 100 includes an insulator 110, a plurality of elastic terminals, an outer shell 140 which is a metallic shell, a pair of side-latches 160, and at least one Electromagnetic Compatibility (EMC) shielding spring. Here, a USB Type-C plug electrical connector is described as an example, and the elastic terminals of the USB T e-C plug electrical connector include a first terminal set 120A and a second terminal set 120B, and the Electromagnetic Compatibility (EMC) shielding springs which are two metallic shielding springs includes an internal shielding spring 130A and an internal shielding spring 130B.

In the embodiment, the first terminal set 120A and the second terminal set 120B are disposed in two rows on the insulator 110 to be parallel to each other. The first terminal set 120A has a pair of grounding terminals G1 and G2, and the second terminal set 120B has a pair of grounding terminals G3 and G4. As clearly shown in FIG. 2, the elastic terminals of the first terminal set 120A and the elastic terminals of the second terminal set 120B are respectively arranged along an axial direction L1. In addition, in the first terminal set 120A, the grounding terminals G1 and G2 are arranged at the outmost side with respect to the remaining elastic terminals along the axial direction L1, and in the second terminal set 120B, the grounding terminals G3 and G4 are arranged at the outmost side with respect to the remaining elastic terminals along the axial direction L1. In other words, in the elastic terminals arranged along the axial direction L1, the grounding terminals G1 to G4 are respectively arranged at the first and/or the last positions. Here, the axial direction L1 is orthogonal to another axial direction L2, and the axial direction L2 is considered as an inserting axial direction of the plug electrical connector 100.

More specifically, the insulator 110 of the embodiment includes a first member 112 and a second member 114, and each of the elastic terminals has a retention section S1 and an elastic section S2. The retention section S1 is fixedly retained in the first member 112. The second member 114 has a plurality of slot holes 114*c* and a plurality of protruding ribs 114*d* arranged along the axial direction L1 and spaced apart with respect to each other. The elastic terminals extend from the first member 112 toward the second member 114 and are suspended, and the elastic sections S2 of the elastic terminals are respectively and correspondingly exposed from the slot holes 114*c*. In other words, the rib 114*d* is located between two adjacent slot holes 114*c* to space apart the two adjacent slot holes and two adjacent elastic terminals. The side-latches 160 are embedded in the first member 112 and extends toward the second member 114. The side-latches 160 are disposed along the axial direction L1 and located at two opposite sides of the elastic terminals, and partially enters grooves 114*a* at two opposite sides of the second member 114. When the plug electrical connector 100 and a receptacle electrical connector 200 (shown in a subsequent drawing) are mated to each other along the axial direction L2, the side-latches 160 which are retention latches serve to be mated to the sides of the mid-plate of the receptacle electrical connector 200 to make ground connections to improve EMC.

In the embodiment, the plug electrical connector 100 includes the pair of shielding springs 130A and 130B and a pair of insulating plates (Mylar) 150A and 150B. The shielding springs 130A and 130B are vertically disposed in correspondence with each other on an exterior surface of the insulator 110, and the insulating plates 150A and 150B are also vertically disposed to the shielding springs 130A and 130B in correspondence with each other, and are located at sides away from the insulator 110. Specifically, each of the shielding springs 130A and 130B has a latching part 132, a tongue part 134, and an spring part 136. The latching part 132 serves to latch the second member 114 of the insulator 110, the tongue part 134 abuts against an interior surface of the outer shell 140 across the insulating plate 150A or 150B, so that the outer shell 140 as well as the shielding springs 130A and 130B can provide an EMI shielding effect together. The spring part 136 passes through an opening 114*b* of the second member 114, and when the plug electrical connector 100 is connected with the receptacle electrical connector 200, the spring part 136 abuts against and grip the receptacle electrical connector 200. The outer shell 140 serves to accommodate the insulator 110, the first terminal set 120A, the second terminal set 120B, the shielding springs 130A and 130B, the insulating plates 150A and 150B, and the side-latch 160.

Figure 3:
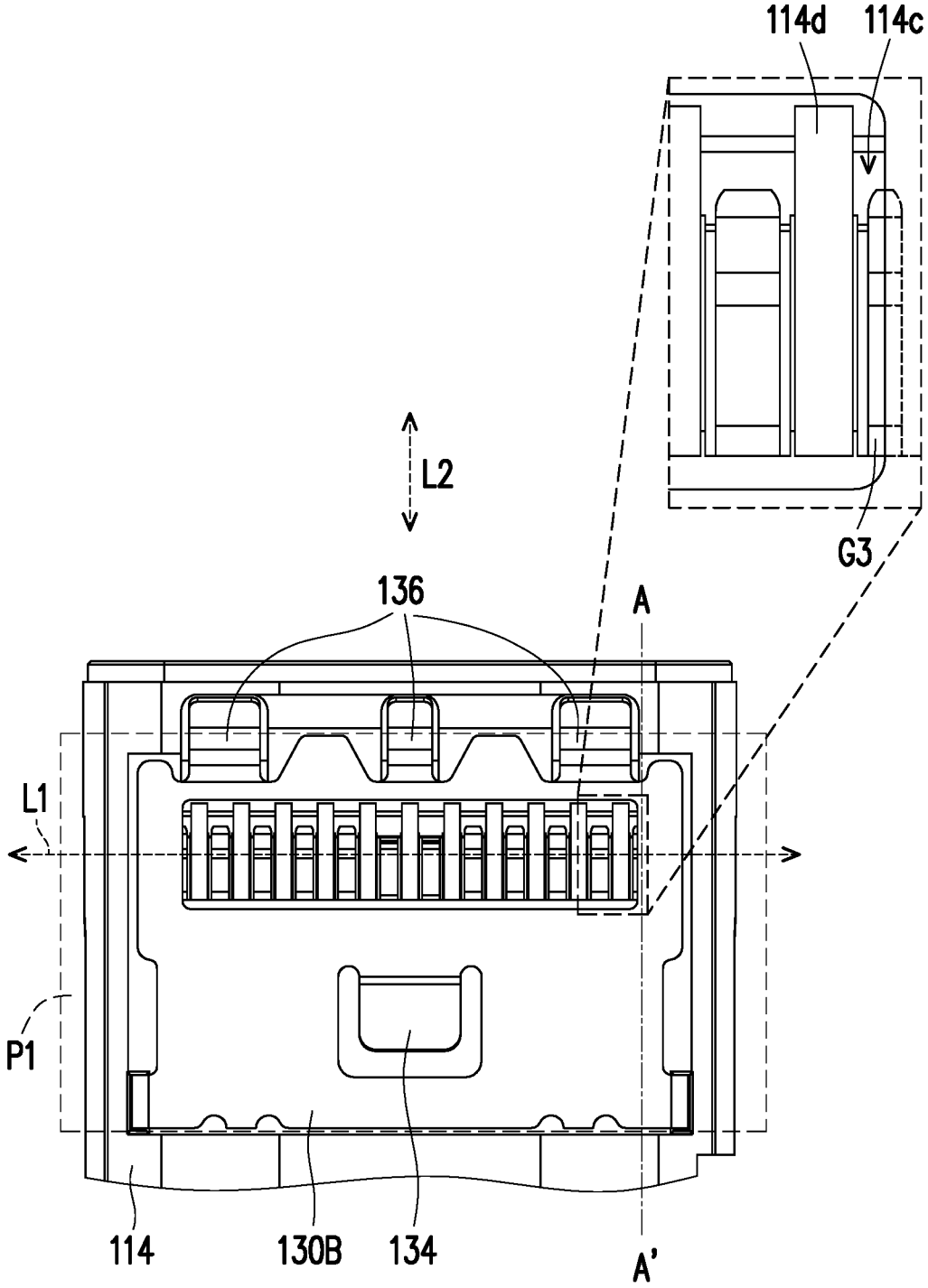
FIG. 3 is a partial schematic diagram illustrating a plug electrical connector.

FIG. 3 is a partial schematic diagram illustrating a plug electrical connector. Here, FIG. 3 is a view from the bottom perspective of FIG. 2. Referring to FIGS. 2 and 3, since the shielding springs 130A and 130B are respectively disposed on the upper and lower surfaces of the insulator 110 and are symmetrical, the shielding spring on one of the surfaces will be described in detail in the following, and since the other surface of the second member 114 and the other shielding spring have the same structures, no further details in these regards will be reiterated.

In the embodiment, each of the shielding springs 130A and 130B has an opening 138. When the shielding spring 130A or 130B is assembled to a top plane P1, the opening 138 is substantially located on the top plane P1 (or a plane parallel to the top plane P1). In this state, the opening 138 may surround the protruding ribs 114*d* of the second member 114. In addition, for the slot holes 114*c* at the outmost side edges, the opening 138 only partially exposes the slot holes 114*c* at the outmost side edges, such as the rightmost and the leftmost slot holes 114*c* shown in FIG. 3. In other words, the elastic terminals of the embodiment, particularly the grounding terminals G1 to G4, thus have the following specific corresponding position relationship with the shielding springs 130A and 130B.

Practically, for the first terminal set 120A and the second terminal set 120B, since the grounding terminals G1 to G4 are disposed at the outmost sides with respect to the remaining elastic terminals, and the openings 138 of the shielding springs 130A and 130B both partially expose the slot holes 114*c* at the outmost, such as the example shown in FIG. 3. Such configuration makes the orthogonal projection of the grounding terminal G3 on the top plane P1 at least partially overlapped with a portion of the shielding spring 130B in the axial direction L1. In other words, a portion of the shielding spring 130B in the axial direction L1 may shield at least a portion of the slot hole 114*c*. To put it in a different way, the opening 138 of the shielding spring 130B only exposes a portion of the grounding terminal G3, and the opening 138 of the shielding spring 130A only exposes a portion of the grounding terminal G1.

Figure 4A:
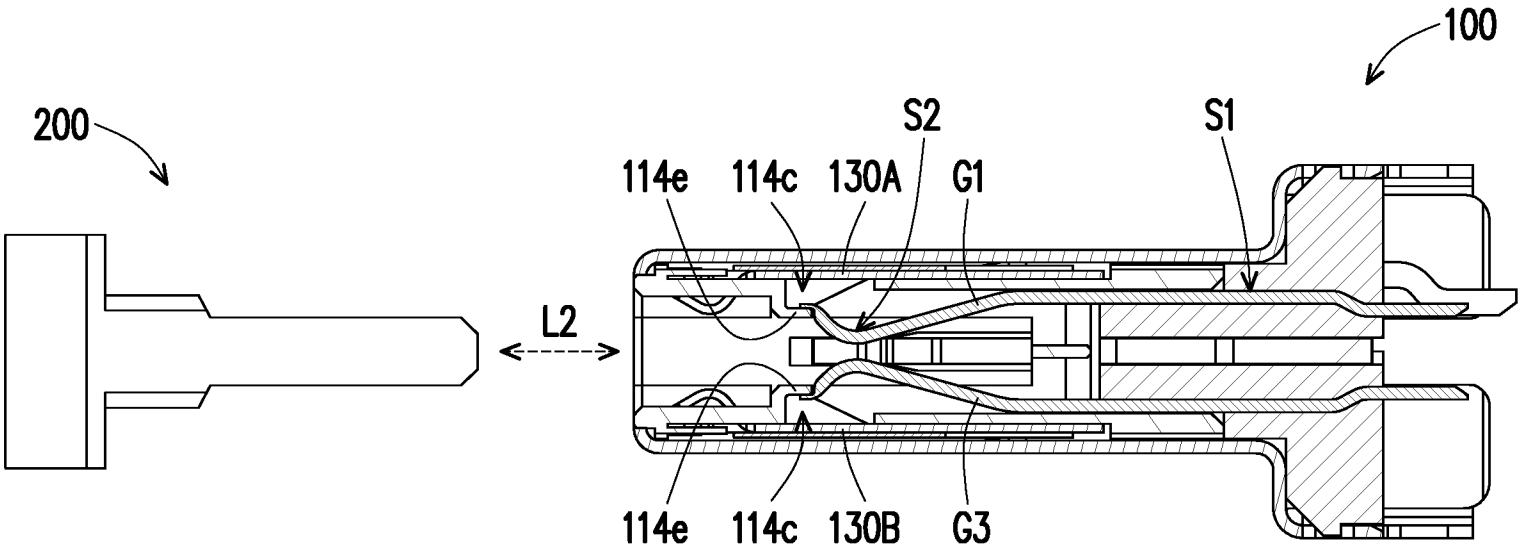
FIGS. 4A and 4B are respectively cross-sectional views illustrating an electrical connector in different states.
Figure 4B:
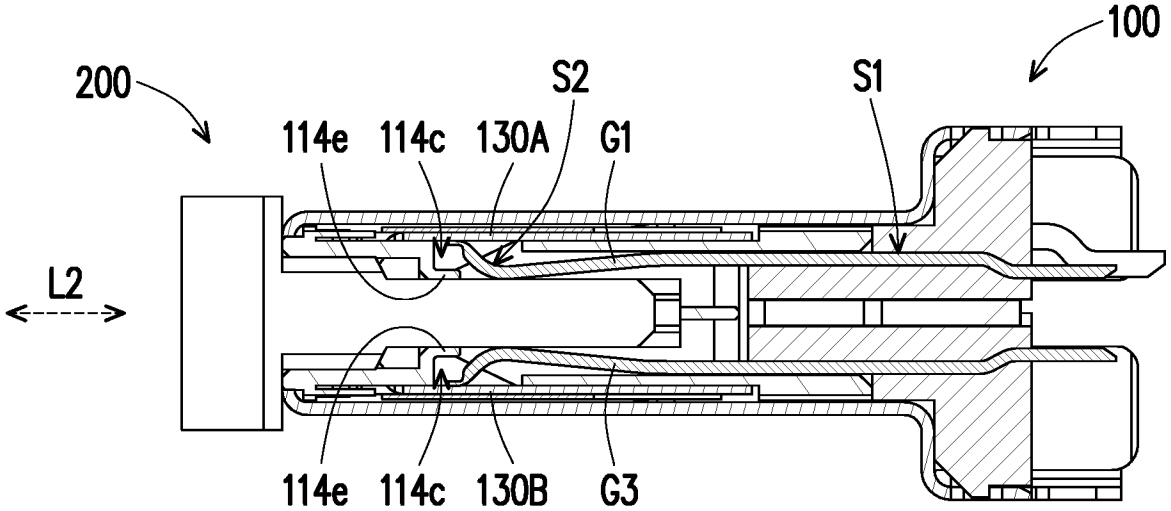
Figure 5:
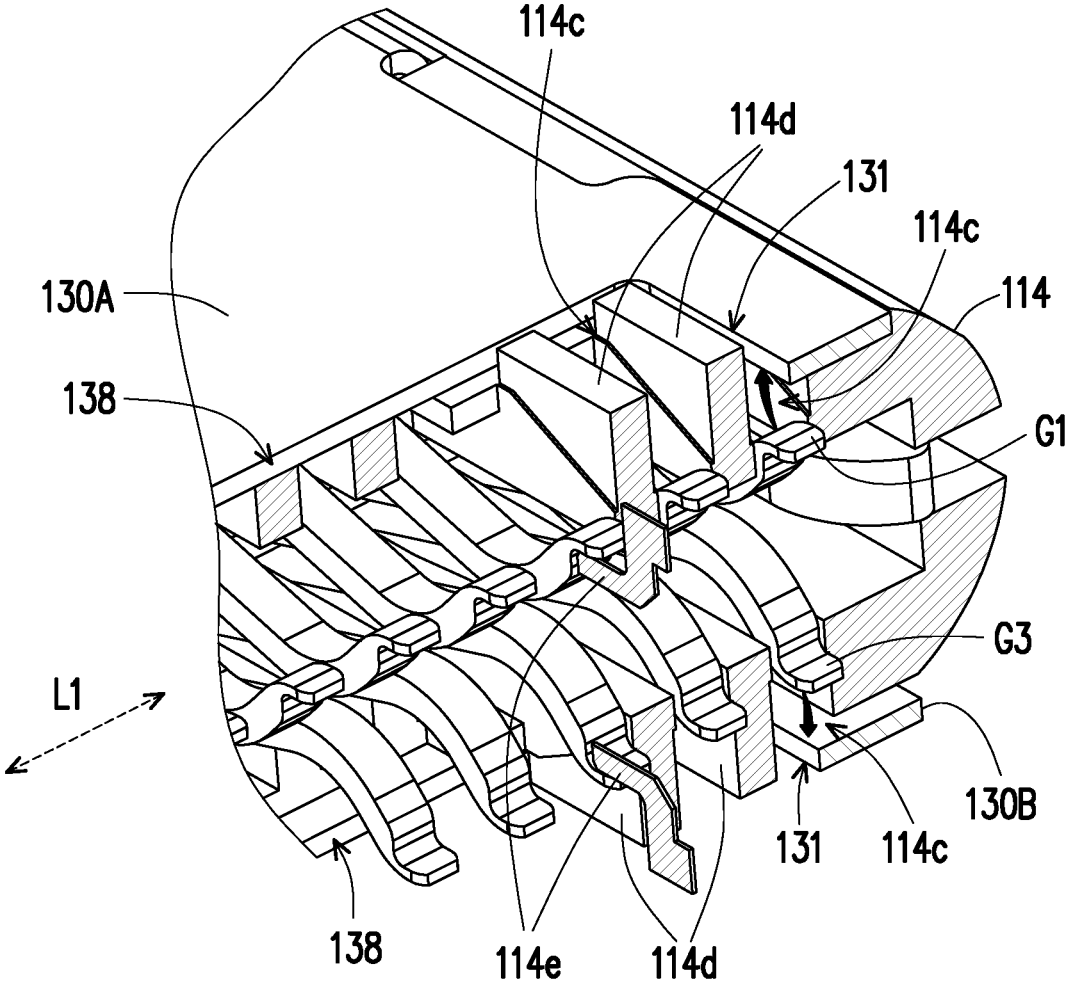
FIG. 5 is a partial cross-sectional view illustrating a plug electrical connector.

FIGS. 4A and 4B are respectively cross-sectional views illustrating an electrical connector in different states. For the plug electrical connector 100, the position where the cross-section is taken is indicated by the A-A' cross-sectional line shown in FIG. 3. FIG. 5 is a partial cross-sectional view illustrating a plug electrical connector. Here, part of the physical structures of the shielding springs 130A and 130B and the second member 114 is removed for the ease of identifying relevant components. Referring to FIGS. 4A, 4B, and 5, in the embodiment, when the plug electrical connector 100 is electrically connected with the receptacle electrical connector 200 (e.g., FIG. 4B), the elastic terminals of the first terminal set 120A and the second terminal set 120B are all bent (elastically deformed) through driving of the receptacle electrical connector 200. Therefore, with the structural properties of the openings 138 of the shielding springs 130A and 130B in the axial direction L1, the grounding terminals G1 to G4 at the outmost sides are moved in the slot holes 114*c* and abut against abutting parts 131 of the shielding springs 130A and 130B. More specifically, the second member 114 further has a plurality of supporting parts 114*e*, and each of the supporting parts 114*e* is disposed in the slot hole 114*c* and located between two adjacent protruding ribs 114*d*. When each of the elastic terminals extends to the second member 114, the end of the elastic section S2 may lean against and be position-limited by the supporting part 114*e*, such as the state shown in FIGS. 4A and 5, and when the plug electrical connector 100 is connected with the receptacle electrical connector 200 (FIG. 4B), the elastic section S2 is driven by the receptacle electrical connector 200 to move in the slot hole 114*c* and therefore contacts the abutting part 131.

In other words, for the shielding springs 130A and 130B of the embodiment, the portions (i.e., the abutting parts 131) of the shielding springs 130A and 130B in the axial direction L1 are located on deformable paths of the grounding terminals G1 to G4. The deformable paths are as indicated by the solid arrow signs marked in FIG. 5, and are located between the supporting parts 114*e* and the abutting parts 131 of the shielding springs 130A and 130B, so as to offer a space for deformation of the grounding terminals G1 to G4. Therefore, after the connection, since the grounding terminals G1 to G4 contact the shielding springs 130A and 130B to be electrically conductive to each other. In this way, the shielding springs 130A and 130B can discharge noise currents that are generated due to the shielding effect through the grounding terminals G1 to G4, so as to provide an electrical grounding effect to the shielding springs 130A and 130B. Meanwhile, the electrical signals between the shielding springs 130A and 130B and the grounding terminals G1 to G4 can also reflect the difference between the states of contacting and not contacting shown in FIGS. 4A and 4B. In other words, based on whether the structures of the shielding springs 130A and 130B and the grounding terminals G1 to G4 contact each other or not, an electrical trigger signal therebetween can be generated. For example, the designer may arrange the electric apparatus having the electrical connector to generate a corresponding function according to whether the electrical trigger signal is generated or not. For example, whether the electronic apparatus is in a normal connection state can be learned, and this property can be further exploited in applications in the technical field of electronic surveillance or the like. It should be noted that even though the embodiment shows that all the grounding terminals G1 to G4 abut against the shielding springs 130A and 130B to change the signal or achieve the function of grounding as needed, the effect can be substantially achieved by bringing one of the grounding terminals G1 to G4 to abut against the shielding spring 130A or 130B as needed in reality.

It should be noted that, even though in the embodiment, the abutting parts 131 shown in FIG. 5 only partially shield the slot holes 114*c* at the outmost side edge and the grounding terminals G1 and G3 in these slot holes 114*c*, under the premise that the embodiment needs the grounding terminals to be bent/deformed and thereby contact the shielding springs through insertion of the connector, the portions of the shielding springs in another embodiment not shown herein may also completely shield the slot holes at the outmost sides. In other words, the structures of the abutting parts 131 may extend along the axial direction L1 and abut against the protruding ribs 114*d* at the outmost side, thereby reinforcing the capability of fixed connection between the shielding springs and the insulator.

In view of the foregoing, in the embodiments of the invention, the shielding springs of the plug electrical connector are substantially located on the deformable path of the grounding terminals through the corresponding configuration among the insulator, the elastic terminals, and the shielding springs. Therefore, when the plug electrical connector is connected to a receptacle electrical connector, the grounding terminals are bent and deformed through driving of the receptacle electrical connector, and further abut against the shielding springs to achieve electrical conduction. Once the plug electrical connector is separated from the receptacle electrical connector, the grounding terminals are restored and no longer bent due to the elasticity, and therefore move away from the shielding springs. In this way, based on whether the grounding terminals contact the shielding springs or not, a trigger effect of being electrically conductive or not, which is similar to a trigger, can be provided. The designer may therefore design an additional function for the plug electrical connector and facilitate the performance of the connector. Meanwhile, when the plug electrical connector is connected to the receptacle electrical connector, the electrical conduction between the grounding terminals and the shielding springs also guide the noise and remove the noise.

Moreover, since the grounding terminals are arranged at the outmost sides with respect to the remaining elastic terminals, thereby forming the openings on the shielding springs, and the sizes of the openings along the axial direction in which the terminals are arranged are adjusted accordingly, the portions of the slot holes at the outmost sides is exposed via the opening. In other words, the shielding springs may partially or completely shield the grounding terminals, so that the grounding terminals can smoothly contact the shielding springs during the bending process, and the structures of the grounding terminals and the shielding springs can be electrically conductive to each other through the structural contact.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A plug electrical connector, comprising:

an insulator;

a plurality of elastic terminals, respectively disposed to the insulator and arranged along an axial direction, wherein the elastic terminals comprise at least one grounding terminal, and the grounding terminal is arranged at an outmost position of the elastic terminals;

at least one shielding spring, assembled to the insulator, wherein a portion of the shielding spring in the axial direction is located on a deformable path of the grounding terminal; and an outer shell, accommodating the insulator, the elastic terminals, and the shielding spring.

2. The plug electrical connector as claimed in claim 1, wherein the shielding spring is located on a top plane of an exterior surface of the insulator, the grounding terminal is located in the insulator, and an orthogonal projection of the grounding terminal on the top plane is at least partially overlapped with a portion of the shielding spring.

3. The plug electrical connector as claimed in claim 1, wherein the plug electrical connector is suitable to be mated with a receptacle electrical connector to deform the elastic terminals, wherein the grounding terminal is driven by the receptacle electrical connector and deformed to abut against a portion of the shielding spring.

4. The plug electrical connector as claimed in claim 1, wherein the insulator has a plurality of slot holes arranged along the axial direction in correspondence with the elastic terminals, so as to expose the elastic terminals, and a portion of the shielding spring in the axial direction shields at least a portion of the slot hole located at a side edge.

5. The plug electrical connector as claimed in claim 4, wherein the insulator further comprises a plurality of protruding ribs, each of the protruding ribs is located between two adjacent slot holes to space apart the two adjacent slot holes and two adjacent elastic terminals.

6. The plug electrical connector as claimed in claim 5, wherein the shielding spring has an opening located on a top plane of an exterior surface of the insulator and surrounding the protruding ribs, and the shielding spring only exposes a portion of the grounding terminal via the opening or the shielding spring completely shields the grounding terminal.

7. The plug electrical connector as claimed in claim 4, wherein the insulator comprises a first member and a second member, each of the elastic terminals has a retention section and an elastic section, wherein the retention section is fixedly retained to the first member, the second member has the slot holes, and the elastic sections are respectively and correspondingly exposed by the slot holes.

8. The plug electrical connector as claimed in claim 7, wherein the plug electrical connector is suitable to be mated with a receptacle electrical connector to deform the elastic terminals, and the elastic section of the grounding terminal is driven by the receptacle electrical connector to move in the slot hole and abut against the shielding spring.

9. The plug electrical connector as claimed in claim 7, wherein the second member has a plurality of supporting parts, each of the supporting parts is disposed in the slot hole and located between two adjacent protruding ribs, and an end of the elastic section leans against the supporting part.

10. The plug electrical connector as claimed in claim 9, wherein in the slot hole where the grounding terminal is located, a deformable path of the elastic section is in a space between the supporting part and the shielding spring when the grounding terminal is deformed.

11. A plug electrical connector, comprising:

an insulator;

a first terminal set and a second terminal set that are disposed in two rows arranged along an axial direction on the insulator and are parallel to each other, wherein the first terminal set comprises a pair of grounding terminals located at opposite side edges and the second terminal set comprises another pair of grounding terminals located at opposite side edges;

a pair of shielding springs that are respectively disposed at upper and lower surfaces of the insulator to respectively correspond to the first terminal set and the second terminal set, wherein portions of the shielding springs in the axial direction are located on deformable paths of the grounding terminals and the grounding terminals are driven by the receptacle electrical connector and deformed to abut against portions of the shielding springs when the plug electrical connector is suitable to be mated with a receptacle electrical connector to deform the first and the second terminal sets; and an outer shell, accommodating the insulator, the elastic terminals, and the shielding springs.

12. The plug electrical connector as claimed in claim 11, wherein the shielding springs are respectively located exterior surfaces of the insulator, one shielding spring is on a top plane of the insulator and another shielding spring is on a bottom plane of the insulator, the grounding terminals are located in the insulator, and an orthogonal projection of the grounding terminals on the top plane and the bottom plane is at least partially overlapped with portions of the shielding springs.

13. The plug electrical connector as claimed in claim 11, wherein the insulator has a plurality of slot holes arranged along the axial direction in correspondence with the elastic terminals, so as to expose the elastic terminals, and portions of the shielding springs in the axial direction shields at least portions of the slot hole located at side edges.

14. The plug electrical connector as claimed in claim 13, wherein the insulator further comprises a plurality of protruding ribs, each of the protruding ribs is located between two adjacent slot holes to space apart the two adjacent slot holes and two adjacent elastic terminals.

15. The plug electrical connector as claimed in claim 14, wherein each shielding spring has an opening, one shielding spring is located on a top plane of an exterior surface of the insulator and surrounding the protruding ribs, another shielding spring is located on a bottom plane of an exterior surface of the insulator and surrounding the protruding ribs, and the shielding springs only expose portions of the grounding terminals via the openings or the shielding springs completely shield the grounding terminal.

16. The plug electrical connector as claimed in claim 13, wherein the insulator comprises a first member and a second member, each of the elastic terminals has a retention section and an elastic section, wherein the retention section is fixedly retained to the first member, the second member has the slot holes, and the elastic sections are respectively and correspondingly exposed by the slot holes.

17. The plug electrical connector as claimed in claim 16, wherein the plug electrical connector is suitable to be mated with a receptacle electrical connector to deform the elastic terminals, and the elastic section of the grounding terminal is driven by the receptacle electrical connector to move in the slot hole and abut against the shielding spring.

18. The plug electrical connector as claimed in claim 16, wherein the second member has a plurality of supporting parts, each of the supporting parts is disposed in the slot hole and located between two adjacent protruding ribs, and an end of the elastic section leans against the supporting part.

19. The plug electrical connector as claimed in claim 18, wherein in the slot hole where the grounding terminal is located, a deformable path of the elastic section is in a space between the supporting part and the shielding spring when the grounding terminal is deformed.

20. The plug electrical connector as claimed in claim 11, wherein the plug electrical connector is a USB Type-C plug electrical connector.

* * * * *